US008162126B2

(12) United States Patent
Meyer et al.

(10) Patent No.: US 8,162,126 B2
(45) Date of Patent: Apr. 24, 2012

(54) INDUCTIVE MEASURING ARRANGEMENT FOR FREE-FALL COIN-OPERATED DEVICES

(75) Inventors: Wilfried Meyer, Buxtehude (DE); Ulrich Cohrs, Horneburg (DE); Anton Gluck, Harsefeld (DE)

(73) Assignee: National Rejectors, Inc. GmbH, Buxtehude (DE)

( * ) Notice: Subject to any disclaimer, the term of this patent is extended or adjusted under 35 U.S.C. 154(b) by 40 days.

(21) Appl. No.: 12/631,222

(22) Filed: Dec. 4, 2009

(65) Prior Publication Data

US 2010/0170766 A1 Jul. 8, 2010

(30) Foreign Application Priority Data

Jan. 7, 2009 (DE) ..... 10 2009 003 993

(51) Int. Cl.
*G07D 5/08* (2006.01)

(52) U.S. Cl. ..... 194/302; 194/317

(58) Field of Classification Search ..... 194/318, 194/302, 317, 320, 344; 73/163; 336/90, 336/92, 96, 98, 220, 221
See application file for complete search history.

(56) References Cited

U.S. PATENT DOCUMENTS

| | | | | |
|---|---|---|---|---|
| 4,924,201 | A * | 5/1990 | Ballard | 336/210 |
| 5,078,252 | A * | 1/1992 | Furuya et al. | 194/318 |
| 6,098,777 | A * | 8/2000 | Hoffman et al. | 194/318 |
| 2009/0078530 | A1 | 3/2009 | Meyer et al. | |

FOREIGN PATENT DOCUMENTS

| | | | |
|---|---|---|---|
| DE | 202 16 785 | U1 | 10/2002 |
| DE | 202.16.785 | U1 * | 2/2003 |
| DE | 102004013286 | A1 | 11/2005 |
| EP | 0839364 | B1 | 6/1998 |
| EP | 1 873 725 | A2 | 1/2008 |

* cited by examiner

*Primary Examiner* — Jeffrey Shapiro
*Assistant Examiner* — Mark Beauchaine
(74) *Attorney, Agent, or Firm* — Vidas, Arrett & Steinkraus, P.A.

(57) ABSTRACT

Inductive measuring arrangement for coin validation in free-fall coin-operated devices, in which at least one elongate coil arrangement on one side of the drop path of the coins extends transversely to the drop path, two coaxial elongate coils being arranged adjacent to one another, a shell core which is E-shaped in cross section being provided, which receives the coils between its outer arms, and a central arm extending, either not at all or only partially, into the outer coil.

7 Claims, 5 Drawing Sheets

INDUCTIVE MEASURING ARRANGEMENT FOR FREE-FALL COIN-OPERATED DEVICES

CROSS-REFERENCE TO RELATED APPLICATIONS

Not applicable

STATEMENT REGARDING FEDERALLY SPONSORED RESEARCH

Not applicable

BACKGROUND OF THE INVENTION

The invention relates to an inductive measuring arrangement for coin validation in free-fall coin-operated devices according to claim 1.

In many conventional coin validators, an inserted coin runs along a descending coin chute and during its path is validated by appropriate sensors for its authenticity. There are extensive prior art documents relating to this subject. The advantage of a coin moving along a coin chute when the measuring is carried out is that the coins have a predetermined position relative to the sensors. As a result, the spacing of the coins from the sensors is not particularly important. A drawback with such coin-operated devices is, however, that the coins are moved relatively slowly through the coin-operated device and in this manner restrict the frequency of insertion.

Free-fall coin-operated devices have become known from EP 0839364, the entire contents of which is incorporated herein by reference, in which the inserted coins fall downwards as a result of gravitational force and are validated for authenticity by sensors assigned to the drop path. The specification for the sensors is particularly high, as the coins fall relatively rapidly through the measuring channel and the position of the coins relative to the sensors fluctuates.

Inductive measuring probes preferably consist of a transmitting coil and a receiving coil, which are arranged on both sides of a coin channel. During this inductive measurement, a distinction is made between a transmissive measurement and a reflexive measurement. During transmissive measurement, the field of the transmitting coil passes through a coin. From the attenuation of the field, the receiving coil measures at least one specific parameter of the coin. During reflexive measurement, the transmitting and receiving coils are located on one side of the free-fall path. This measurement detects the surface and/or the region close to the surface of the coins as, for example, specific outer layers. From DE 10 2004 013 286, the entire contents of which is incorporated herein by reference, a coil arrangement has already become known in which the transmitting coil is wound onto an elongate ferrite core, and the receiving coil of smaller diameter is arranged recessed on the front face of the magnetic core in a recess. The core permits a relatively uniform magnetic field, and the receiving coil is substantially decoupled from the transmitting field. As a result, it is possible to undertake a reflexive coin measurement by means of the inductive probe, irrespective of the spacing of the coin. If a further receiving coil is arranged on the opposing side of the coin path, a transmissive measurement may be undertaken by means of the known coil arrangement. The arrangement is advantageous for use in multifrequency technology, in which a plurality of harmonics of the alternating magnetic field of the transmitting coil are examined for their effect on the coins.

BRIEF SUMMARY OF THE INVENTION

The object of the invention is to provide an inductive measuring arrangement for coin validation in free-fall coin-operated devices, which is well suited both for transmissive measurement and reflexive measurement of coins in free-fall coin-operated devices.

In the inductive measuring arrangement according to the invention, two elongate coils arranged coaxially adjacent to one another are accommodated in an E-shaped shell core. The central arm of the E-shaped shell core extends through a first coil, and not at all or only partially into the second outer coil.

In one embodiment of the measuring arrangement according to the invention, an elongate linear coil body made of plastics is provided which comprises two peripheral grooves arranged at a short axial distance for receiving at least one respective coil winding and within the region surrounded by the grooves has an elongate, axially aligned recess on one side of the coil body, the depth of the recess being able to extend at least as far as the facing groove. A shell core made of ferrite is E-shaped in section and receives the coil body between its outer arms with an approximate fit. The central arm extends into the recess.

Such an inductive measuring arrangement is suitable both for transmissive measurement and for reflexive measurement. During transmissive measurement, only one coil winding is required as a transmitting coil and one coil winding is required as a receiving coil on opposing sides of the drop path. During reflexive measurement, a coil body is required on at least one side, in which a transmitting coil winding and a receiving coil winding are arranged in one respective groove. As, however, the spacing of the coins from the coil arrangement is not fixed and the coins are closer to either one or the other channel wall of the drop path, it is advantageous if a reflexive and transmissive measurement is respectively undertaken on the opposing sides of the drop path.

The measuring arrangement according to the invention is used for measuring free-fall coins. As the drop path is intended to be as short as possible for structural reasons, it is very advantageous if the elongate coil shape has a very narrow width. Preferably, the ratio of the sides is 4:1, i.e. the long side is four times the length of the narrow side. As a result, an effective measuring width of the channel is possible. Moreover, the overall height is kept low. A short distance in the drop direction also has the advantage that a short measuring time is achieved so that a high insertion frequency is possible. Finally, as a result of the low measuring height of the coils, it is also possible to distinguish relatively easily between the ring material and core material in so-called bicolour coins. Only the ring material is detected in the edge region and substantially the core material is detected in the central region.

From DE 10 2007 046 390, the entire contents of which is incorporated herein by reference, it has already become known to carry out two reflexive and two transmissive measurements in succession using one respective transmitting coil and one receiving coil on each side of a coin chute. These measuring methods may be used advantageously by means of the inductive measuring arrangement according to the invention, identical coil bodies being able to be used on each side of the free-fall path. It merely depends on whether a receiving coil is also wound onto the same coil body, in addition to a transmitting coil, in order to use both measuring methods on each side of the drop path.

As, in the inductive measuring arrangement according to the invention, the central core portion only extends in the region of the respective transmitting coil but preferably not into the receiving coil, in reflexive measurement there is less coupling between the transmitting coil and receiving coil. Although the decoupling is not as extensive as in the above-described known coil arrangement, in which the transmitting coil is wound onto an elongate coil body and the receiving coil is arranged in a recess of markedly smaller diameter on the front face of the core, with an inductive measuring arrangement according to the invention an optimum measuring result is achieved when it is desired to carry out both a transmissive and a reflexive measurement on opposing sides of a free-fall path in a free-fall coin-operated device.

In the invention, the coil body is preferably formed in one piece from a suitable plastics material, according to one embodiment of the invention a projection being formed on the coil body, extending beyond one end of the coil body, which receives solder pins in preformed holes, which in turn may be connected to the wire ends of the coil winding.

According to a further embodiment of the invention, on opposing sides of the coil body, tabs of smaller thickness are formed in the central region which, after folding down over at least one groove, cover the coil winding in a protective manner at the side. After the forming, the tabs initially project laterally outwards and are only folded down after the coil winding is wound on. The tabs protect the windings, in particular, when the coil body is inserted into the ferrite shell. Moreover, they permit the clamped fixing of the coil body in the shell. Bonding is not necessary.

BRIEF DESCRIPTION OF THE SEVERAL VIEWS OF THE DRAWINGS

An embodiment of the invention is described in more detail hereinafter with reference to the drawings, in which.

DETAILED DESCRIPTION OF THE INVENTION

While this invention may be embodied in many different forms, there are described in detail herein a specific preferred embodiment of the invention. This description is an exemplification of the principles of the in invention and is not intended to limit the invention to the particular embodiment illustrated.

Figure 1:
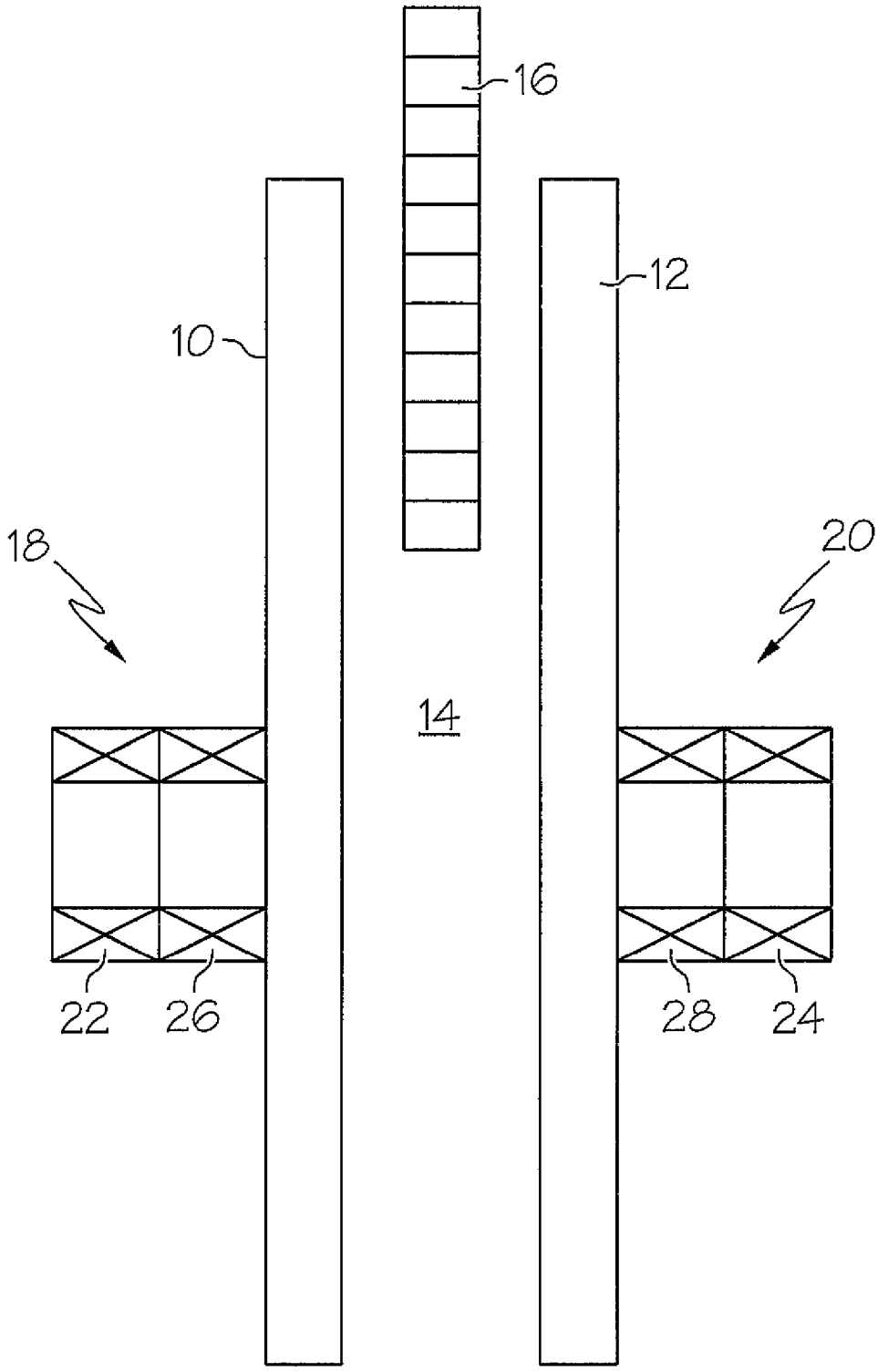
FIG. 1 shows schematically an inductive measuring arrangement in a free-fall coin-operated device with transmitting and receiving coils on each side of the drop path.

Two walls 10, 12 of a free-fall coin-operated device define a drop path 14 for coins, of which one is shown at 16. On opposing sides, two inductive measuring arrangements 18, 20 are arranged respectively with one transmitting coil 22, 24 and one receiving coil 26, 28. The coils 22 to 28 extend in a linear manner perpendicular to the drawing plane over the entire width of the drop path 14. As a result, coins of any diameter always fall through the measuring region of the measuring arrangements 18, 20. The principal construction of the measuring arrangements according to FIG. 1 is known.

Figure 2:
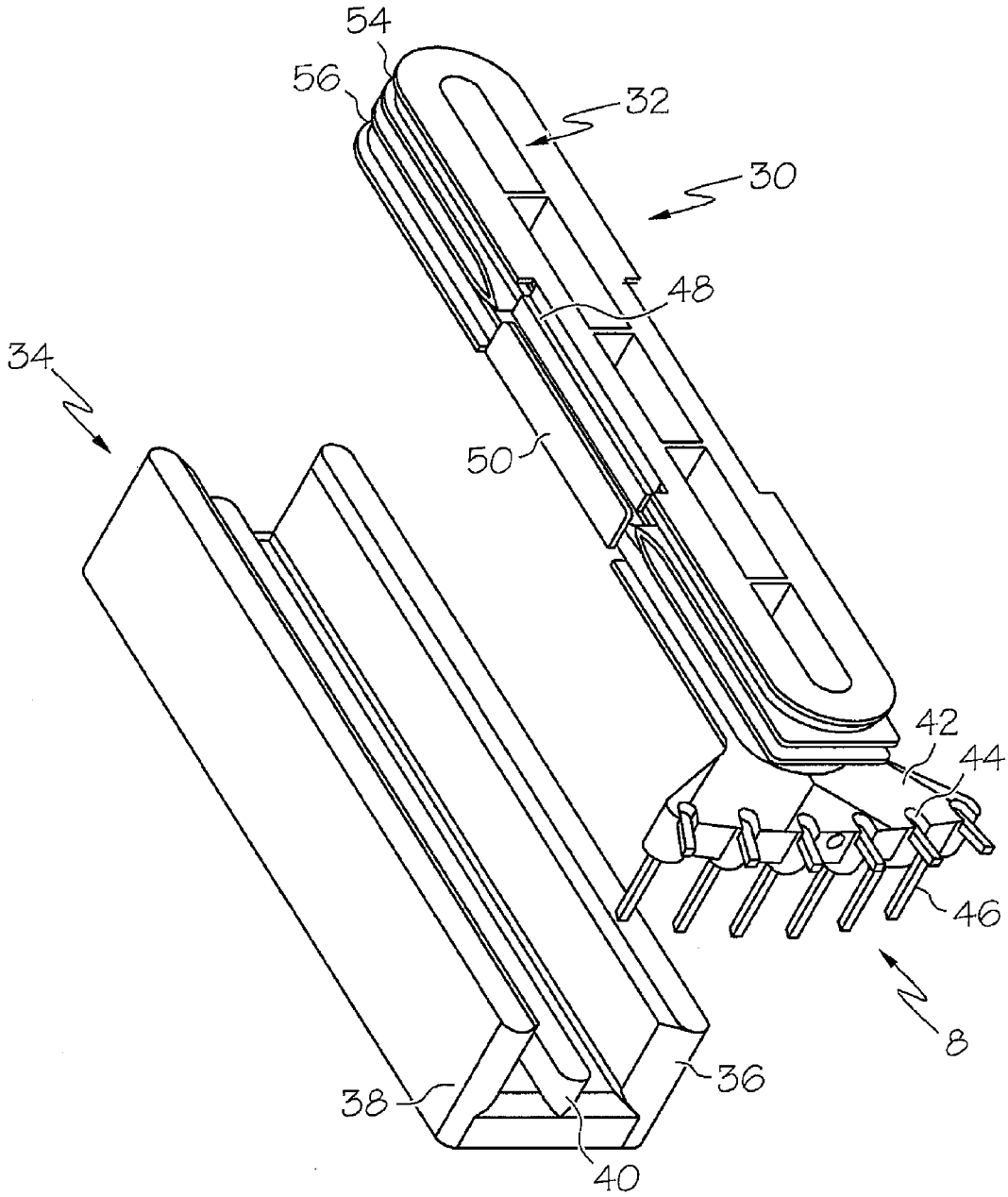
FIG. 2 shows in perspective a coil arrangement and a shell core in exploded view.
Figure 3:
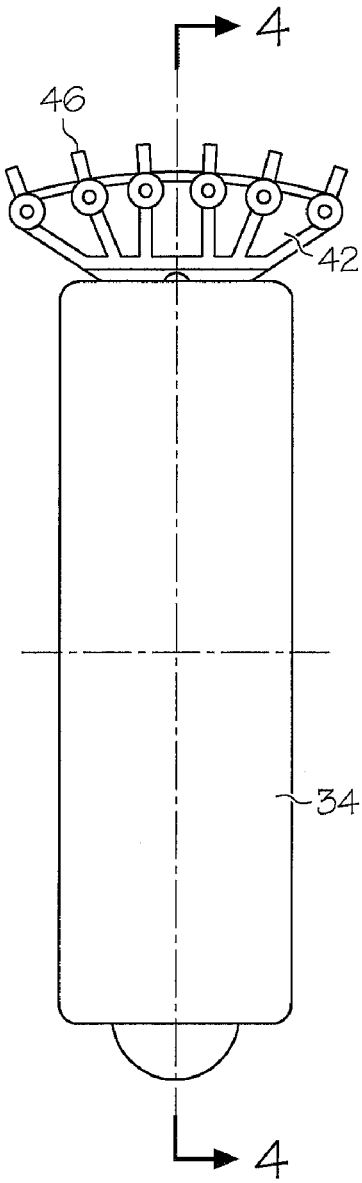
FIG. 3 shows the assembled arrangement according to FIG. 2 in side view.

In FIG. 2, an elongate coil arrangement 30 may be seen with a coil body 32 which receives coil windings 54, 56 in two coaxial grooves. Further details will be provided about this below. The coil arrangement 30 is inserted into a shell core 34 made of ferrite which in cross section is E-shaped with two outer arms 36, 38 and a central arm 40. As is visible, the central arm 40 extends over less than half the height of the arms 36, 38.

The coil body 32 is formed in one piece from a suitable plastics material, and has at one end a triangular projection 42, which receives solder pins 46 in holes 44. The solder pins are angular. The wire ends of the coil windings 54, 56 are connected to the solder pins 46, by being soldered thereto. A further winding may also be present with the coil winding 56, for compensation purposes. The coil is preferably wound in a bifilar manner.

Tabs 48, 50 are formed on the coil body 32 on opposing sides and centrally with regard to the longitudinal extension of the coil body 32. They are folded down after the winding of the coils, and cover the coils in the central region so that the coils are protected when inserted into the shell core.

Figure 4:
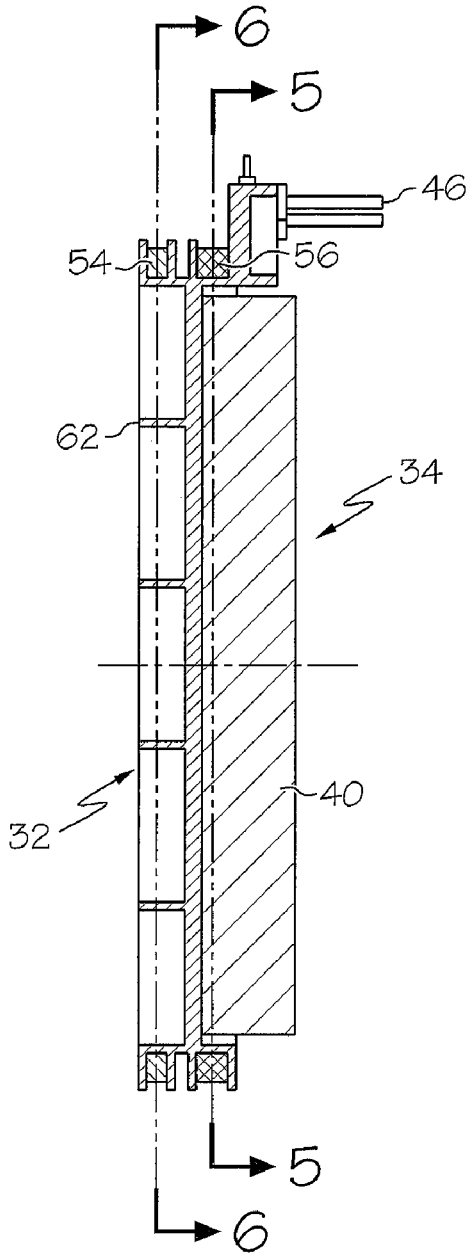
FIG. 4 shows a section through the view according to FIG. 3 along the line 4-4.
Figure 5:
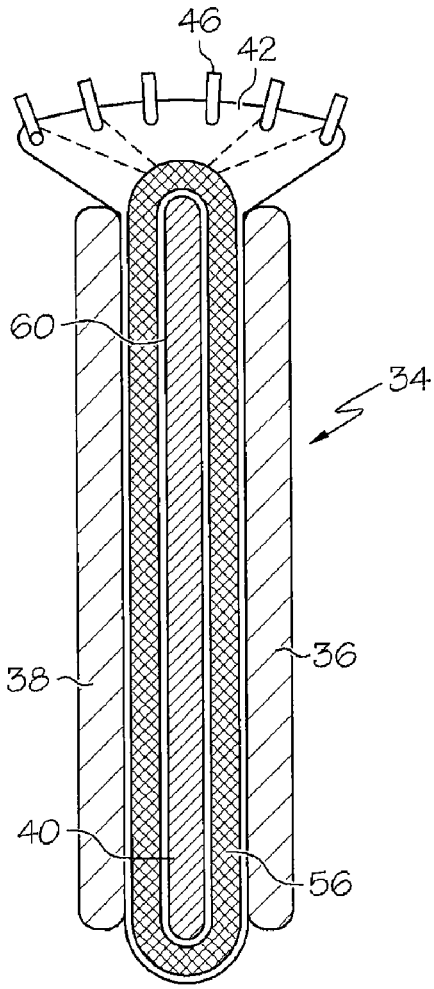
FIG. 5 shows a section through the view according to FIG. 4 along the line 5-5.
Figure 6:
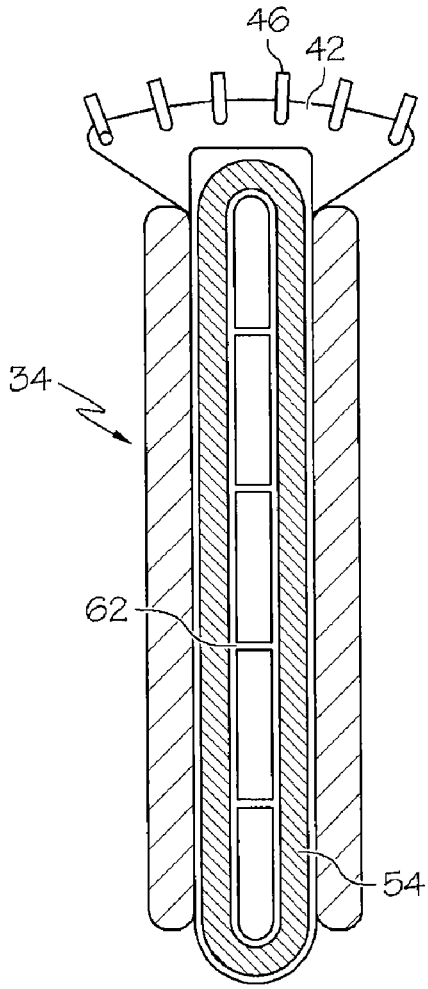
FIG. 6 shows a section through the view according to FIG. 4 along the line 6-6.
Figure 7:
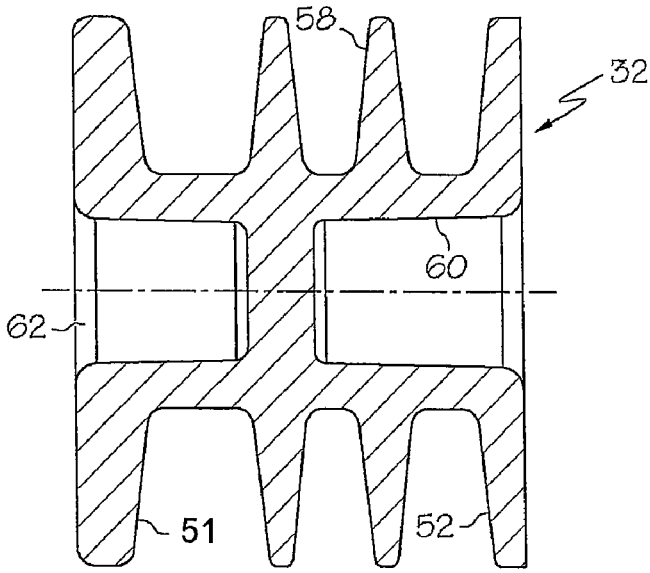
FIG. 7 shows a section through the coil body according to FIG. 2 without coil windings.
Figure 8:
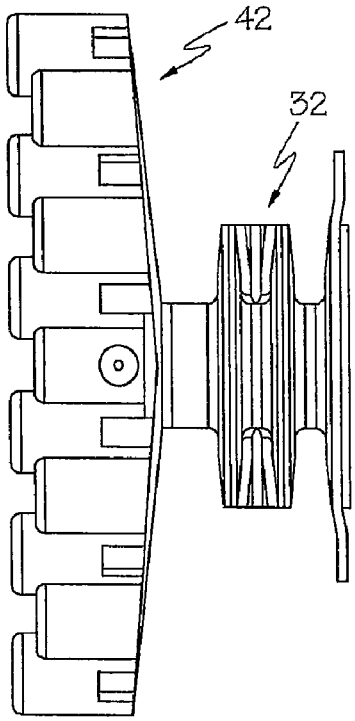
FIG. 8 shows the end view of the coil arrangements in FIG. 2 in the direction of the arrow 8.

As is visible in FIG. 7, the coil body 32 has two peripheral grooves 51, 52 which are trapezoidal in section. They widen outwardly. The grooves 51, 52 receive a coil 54 and 56 respectively, as also visible in FIG. 4. Between the grooves 51, 52 which run around the coil body 32, respective peripheral groove portions 58 are located coaxially, which respectively only extend as far as the tabs 48, 50. They form the spacing between the grooves 51, 52. As is further visible in FIG. 7, on one side of the coil body 32 an elongate axial recess 60 is formed. It extends substantially over the entire length of the coil body. The depth of the recess 60, however, extends only slightly beyond the groove 52, as far as the central groove portions 58. On the other side, the coil body 32 has a row of projections 62 spaced apart in the longitudinal direction. As may be seen, the coil arrangement 30 may be inserted into the shell core, the arms 36, 38 being flush with the opposing surface of the coil body 32. This surface then faces the drop path 14 in FIG. 1. The central arm 40, however, extends into the recess 60 and therefore only covers the groove 52, but not the groove 51.

During use as an inductive measuring arrangement, the coil 56 is the transmitting coil, and the coil 54 is the receiving coil. It may be seen that between the transmitting coils 54 and the receiving coil 56, there is less coupling than in conventional coil arrangements in which the core extends through both coils.

A reflexive measurement of the coins is, therefore, possible. A reflexive measurement from both sides of the drop path is thus necessary when the coins do not have identical outer layers, and it is not certain which coin surface faces which measuring arrangement. Moreover, the spacing of the coins from the receiving coil during measurement is reduced, which may be compensated by a measurement on both sides, as in transmissive measurement.

The central arm 40 of the shell core determines the coupling of the two coils. Its length may thus be adapted for optimum measurement.

This completes the description of the preferred and alternate embodiments of the invention. Those skilled in the art may recognize other equivalents to the specific embodiment described herein which equivalents are intended to be encompassed by the claims attached hereto.

What is claimed is:

1. In an inductive measuring arrangement for coin validation in free-fall coin-operated devices, said free-fall coin-operated device having a pair of walls defining a drop path for a coin in which at least one elongate coil arrangement on one side of the drop path of the coins extends transversely to the drop path, the improvement comprising:

two coaxial elongate coils are arranged adjacent to one another, a shell core (34) which is E-shaped in cross section is provided having outer arms and a lower central arm, which receives the coils between its outer arms, and the central arm (40) extending, either not at all or only partially, into the outer coil which is the coil furthest from the drop path.

2. The inductive measuring arrangement according to claim 1, wherein a projection (42) is formed on the coil body (32), extending beyond one end of the coil body (32), which receives solder pins in preformed holes, which in turn may be connected to wire ends of the winding (54, 56).

3. The inductive measuring arrangement according to claim 1, wherein an elongate coil body (32) made of plastics is provided which comprises two peripheral grooves (51, 52) arranged at an axial distance from each other by peripheral groove portions (58) for receiving at least one respective coil winding (54, 56) and within the region surrounded by the grooves (51, 52) an elongate, axially aligned recess (60) is provided on one side of the coil body for receiving the central arm (40).

4. The inductive measuring arrangement according to claim 3, wherein the depth of the recess extends at least to the groove closest to the drop path (52).

5. The inductive measuring arrangement according to claim 3, wherein on opposing sides of the coil body (32), tabs (48, 50) are formed in the central region which, after folding down over at least one groove, cover the coil winding (54, 56) at the side.

6. The inductive measuring arrangement according to claim 3, wherein on each side of the drop path a coil arrangement is arranged, each coil body (32) in each groove receiving at least one coil winding (54, 56), and the coil winding (56) closest to the drop path being a transmitting coil and the other coil winding being a receiving coil.

7. The inductive measuring arrangement according to claim 3, wherein between the grooves (51, 52) central groove portions (58) are formed which determine the spacing between the grooves (51, 52).

* * * * *